United States Patent [19]

Mitchell et al.

[11] Patent Number: 4,682,776

[45] Date of Patent: Jul. 28, 1987

[54] USER WORN ARM BEND CONTROL DEVICE

[76] Inventors: William Mitchell, 618 S. Seventh St., Delavan, Wis. 53115; Herbert Langston, 501 E. 32nd, Apt. 1211, Chicago, Ill. 60616

[21] Appl. No.: 795,327

[22] Filed: Nov. 6, 1985

[51] Int. Cl.[4] ..... A63B 69/36

[52] U.S. Cl. ..... 273/189 A; 273/54 B; 273/29 A; 403/111; 128/77

[58] Field of Search ..... 273/189 R, 189 A, 183 B, 273/54 B, 188 R, 190 R, 29 A; 128/77; 403/111

[56] References Cited

U.S. PATENT DOCUMENTS

| | | | |
|---|---|---|---|
| 1,226,160 | 5/1917 | Allis | 273/189 A |
| 1,457,710 | 6/1923 | MacDonald | 273/189 A |
| 3,594,007 | 7/1971 | Kalberer | 273/183 B |
| 3,689,389 | 10/1972 | Guedel | 128/77 |
| 3,970,305 | 7/1976 | Hawkins | 273/54 B |
| 4,132,407 | 1/1979 | Davis | 273/54 B |
| 4,333,647 | 6/1982 | Schaefer | 273/54 B |
| 4,359,221 | 11/1982 | Taylor | 273/54 B |
| 4,367,872 | 1/1983 | Langston | 273/54 B |

*Primary Examiner*—George J. Marlo
*Attorney, Agent, or Firm*—Milton S. Gerstein; Marvin N. Benn

[57] ABSTRACT

An arm-straightening device for selectively locking an arm in a straight position, so that a bowler, or the like, is prevented from bending the arm during delivery, but which automatically allows the arm to bend during follow-through. A pair of semicircular-shaped, arm-shells are pivotally connected together at adjacent end-portions. An elastic, elongated band is positioned on the rear surfaces of the two shells and held in a first, stable state by a series of pins projecting from the rear surfaces of the shells. The band, in its first state, tends to keep the shells in an aligned, rectilinear orientation to keep the arm to which they are secured straight. Upon the application of sufficient force by the lower arm, in order to bend it, the elongated, elastic band is caused to take a second, stable state that tends to bias the shells into a bent orientation to keep the arm in its bent position for follow-through, or the like. The band is kept in its second, stable state by stop-pins projecting from the rear surface of at least one shell, which stop-pins lie on the opposite side of the pivot-axis of the shells as compared to the other pins when the other pins are in the first, stable state. The first state of the elastic band and the shells is also automatically assumable by the application of sufficient torque from the lower arm tending to straighten the arm.

14 Claims, 10 Drawing Figures

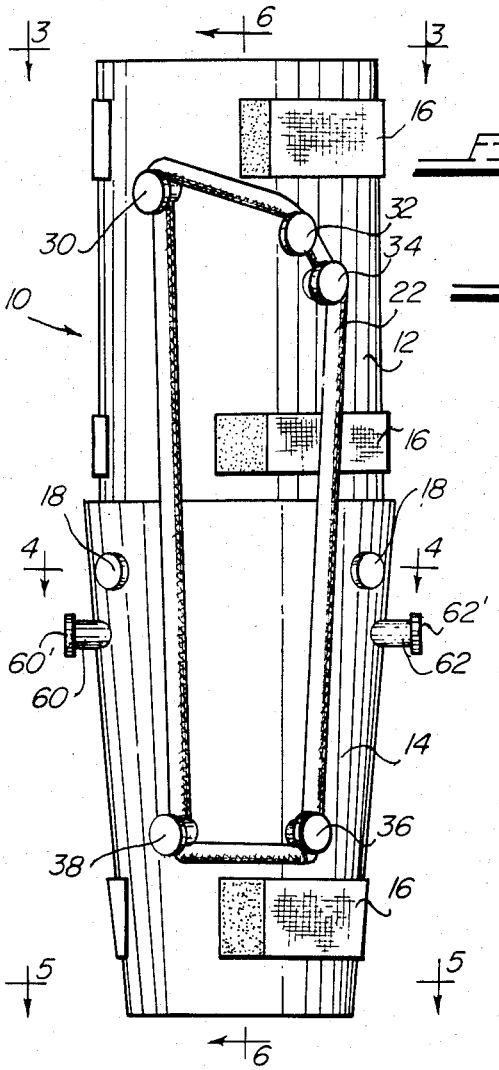
FIG-1
FIG-2
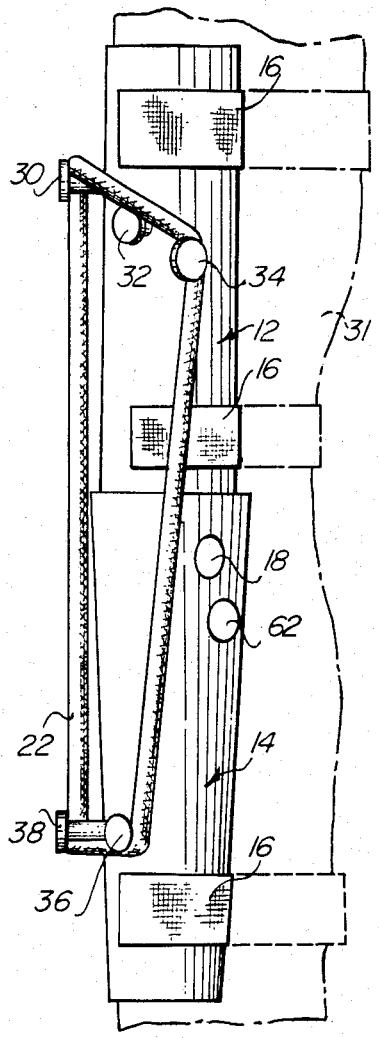
FIG-3
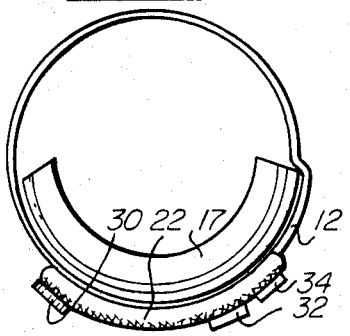
FIG-4
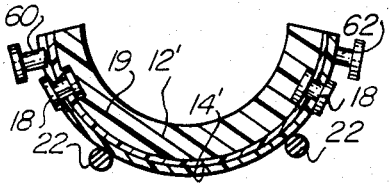
FIG-5
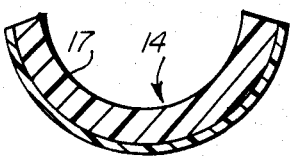

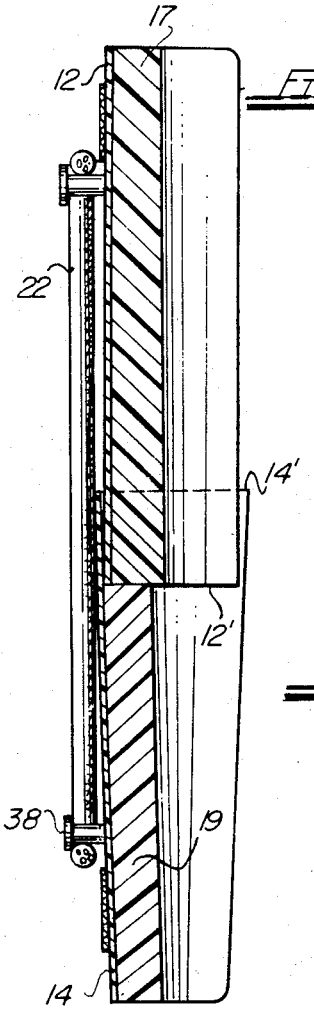
FIG. 6
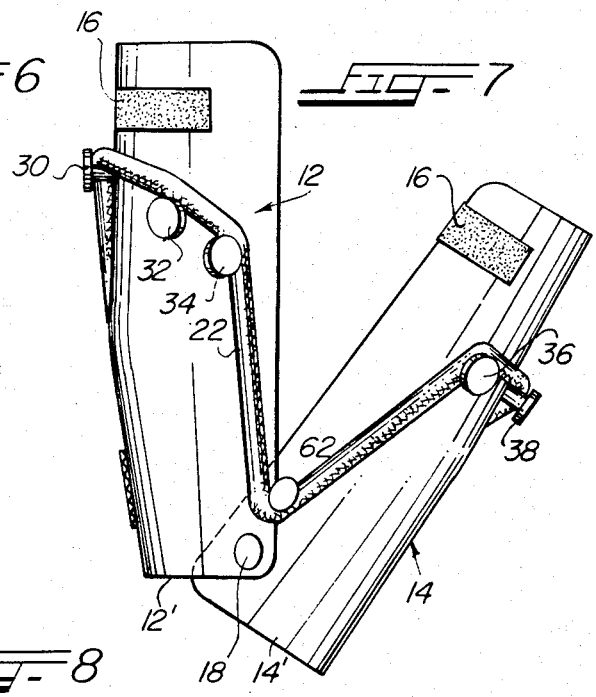
FIG. 7
FIG. 8
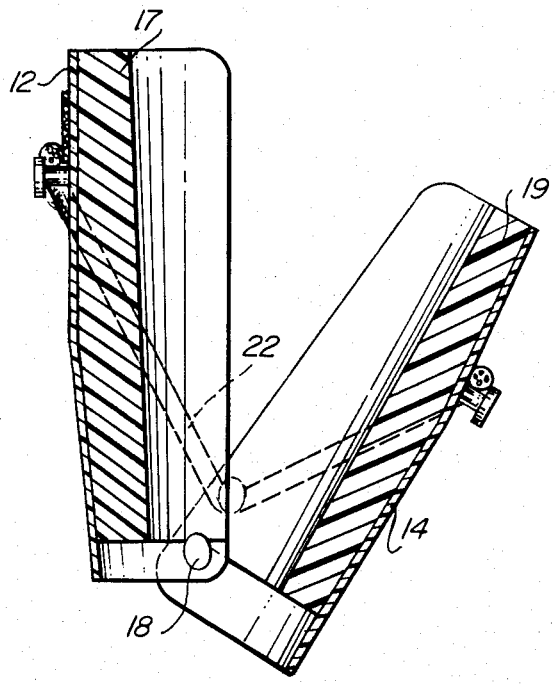

USER WORN ARM BEND CONTROL DEVICE

BACKGROUND OF THE INVENTION

The present invention is directed to a bowler's device for aiding the bowler in keeping his arm straight when rolling the ball during delivery, in order to increase the accuracy by which the bowling ball is rolled down an alley. The device of the present invention may also be used in any sport where it is desired to keep at least one arm of the sportsman as straight as possible, such as, for example, in golfing, where the arm closest to the fairway must be kept as straight as possible during the forward portion of the swing. The device of the present invention may also be used by a tennis player in the same manner, and may be used to instruct and teach a novice in the sport, by habituating him to keep his arm straight, in the proper manner. Aiding devices for keeping a bowler's arm straight are known, and have been used also for other sports, as well as for use as an orthopedic brace. However, all such prior-art locking devices require the user thereof to manually manipulate the locking device to allow for the bending of the arm to which the device is secured. Thus, whenever a user of these prior-art devices desires to allow for the bending of his or her arm, the lock of the device must be manually released either by using the other, free arm, or by another person entirely. The problem with this manner of unlocking the arm-straightening device is that it cannot allow for follow-through of the arm after completing the arm-swing required. For example, in the sport of bowling, when it is necessary to keep the arm straight during approach to the alley and during the back-swing and for most of the forward-swing of the arm, it is also necessary to allow for the arm to follow-through in order to impart sufficient rotation to the ball to allow for a hooked-path of travel thereof down the alley. The spin thus given to the ball causes it to take a curved path, which has long been known as increasing pin-action, leading to higher scores. Further, by allowing the arm to bend at the end-point of delivery, greater accuracy is achieved when aiming the ball at a chosen arrow on the alley. Hitherto, prior-art arm-locking devices have not allowed any bending of the arm at the end of delivery, thus preventing proper and effective follow-through. The same principal applies also for other sports, such as golf and tennis, where a follow-through is necessary after the hitting of the ball. It is, therefore, advantageous to provide an arm-straightening device for sportsmen that also allows for the automatic bending of the arm at a certain stage during delivery to provide for proper and correct follow-through.

SUMMARY OF THE INVENTION

It is, therefore, the primary objective of the present invention to provide a sportsman's arm-locking device that not only keeps the arm of the sportsman straight to aid in the proper release thereby, but also allows for the automatic bending of the very same arm at the end-point of travel of the arm so that proper and correct follow-through may ensue, without assistance by another person or the other arm of the sportsman.

It is another objective of the present invention to provide an arm-locking device for sportsmen, such as bowlers, golfers, tennis players, and the like, such that the arm is allowed to bend only at the stage of travel of the arm where the proper follow-through thereof begins.

It is still another objective of the present invention to provide an arm-locking device for sportsmen that is easily and readily re-positioned in its original arm-straightening condition after the bending thereof during follow-through.

It is still another objective of the present invention to provide an arm-straightening device for bowlers, and the like, that is easily mounted to the arm of the sportsman and easily removed therefrom.

It is also an objective of the present invention to allow for the fitting of the arm-straightening device of the present invention to any-sized arm by adjusting the tensioning thereof.

Toward these and other ends, the arm-locking and straightening device for bowlers, and the like, of the present invention is provided with an upper, semicircular-shaped shell portion for securement to the rear portion of the upper arm, and a lower, semicircular-shaped shell portion for securement to the rear portion of the lower arm. The two shell portions are rotatably mounted together at adjacent end-portions, so that when the lower arm is rotated relative to the upper arm with sufficient force, the lower shell and upper shell-portions may take the concomitant relative positions associated with the bent arm. The shell portions may assume two relative, stable states: The first state constituting linear alignment between the shell-portions to keep the arm straight, and the second state, where the shell-portions extend at an acute angle with respect to each other. In each state, the shell portions are biassed about their pivotal mounting to keep the shells in that state until a significant force is applied by the lower arm to change the state to the other state.

In the preferred embodiment, the very same biassing element is used to bias the shells in each of the two possible states assumable by them, the biassing element being constituted by an elongated, elastic band, or the like, formed into a closed loop about the rear surfaces of the two shell-portions. Boundary pins tension the band and keep it in place on the rear surfaces during the first state of the shell-portions. When the lower arm is bent with sufficient force to force the lower shell-portion to overcome the force provided by the band, to thus rotate the lower shell with respect to the upper shell, the band assumes a new position or state urging the two shells toward each other defining the second state thereof, so as to form an acute angle between the shell-portions. The loop of the band includes two elongated leg-portions that assume a bent configuration upon the relative rotation of the shell-portions, such that the force exerted thereby is positioned on the side of the pivot mount of the shell-portions opposite to the side to which they are located when the shells are in the first, linear state. Stop-pins limit the outward movement of the leg-portions of the loop during the relative pivotal rotation of the shell-portions.

In use, when using the brace for bowling, or the like, during the forward movement of the arm for releasing the ball, or the like, the arm is prevented from bending in the first state of the biassing element. After the arm has reached its forward-most point of delivery, and follow-through is required, the lower arm overcomes the biassing force by pivotting relative to the upper arm, after which the biassing force assumes its second state to urge the two shells into their relatively-angled, bent position, to ensure the bent-arm configuration for the follow-through. The biassing element is adjustable so as to adjust the tension thereof according to each individual user.

BRIEF DESCRIPTION OF THE DRAWING

The invention will be more readily understood with reference to the accompanying drawing, wherein FIG. 1 is a rear, plan view of the arm-straightening and locking device of the present invention;

FIG. 2 is a side, elevational view thereof;

FIG. 3 is an end view along line 3—3 of FIG. 1;

FIG. 4 is a cross-sectional view taken along line 4—4 of FIG. 1;

FIG. 5 is a cross-sectional view taken along line 5—5 of FIG. 1;

FIG. 6 is a cross-sectional view taken along line 6—6 of FIG. 1;

FIG. 7 is a side, elevational view similar to FIG. 2 showing the device in its second state where the two arm-shell portions are at an acute angle with respect to each other to assume the configuration of a bent arm when in follow-through;

FIG. 8 is a cross-sectional view similar to FIG. 7;

DETAILED DESCRIPTION OF THE INVENTION

Figure 9:
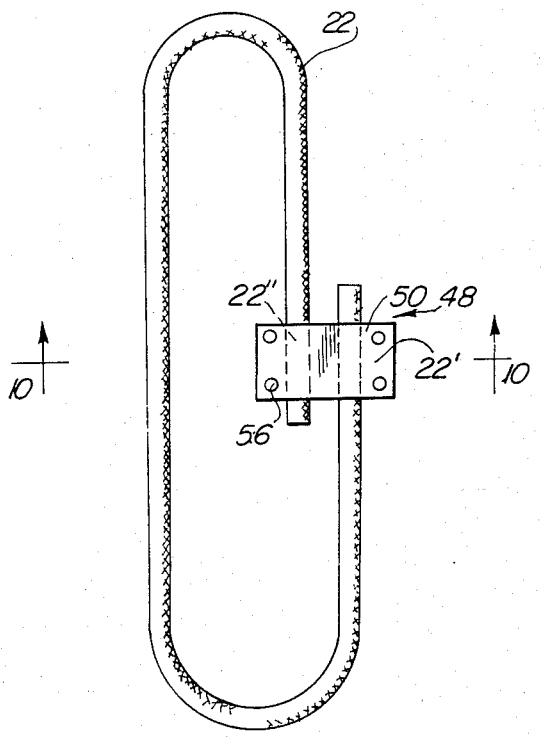
FIG. 9 is a plan view showing the biassing element of the present invention with an adjustable clamping member for adjusting the biassing force thereof.

Referring now to the drawing in greater detail, the arm-straightening and locking device of the present invention is indicated generally by reference numertal 10, and includes an upper-arm, semicircular-shaped shell 12, and a lower-arm, semicircular-shaped shell 14. The shell 12 is securable about the rear portion of the upper arm of a person, while the shell 14 is securable about the rear portion of the lower arm of the person. Each shell 12 and 14 is also provided with a semicircular lining along the inner surface thereof, indicated by reference numerals 17 and 19 for the shells 12 and 14, respectively. This lining may be made of any soft material to provide a soft touch to the skin of the arm. Hook-and-pile type fasteners 16, or any other conventional fastening elements, secure the shells to the respective portions of a person's arm 31, seen in FIG. 2. As can be seen in FIGS. 1, 2, and 6, the upper shell 12 is pivotally connected to the lower shell 14 via pivot pins 18 at adjacent overlapping end-portions of the shells 12 and 14, with the end-portion 12'—best seen in FIG. 7—lying along the arm-contacting surface of the end-portion 14' of the lower shell 14, though the particular form by which the relative rotation between the shells 12 and 14 is carried out may be varied. When securing the two shells 12 and 14 to the arm of a person, the pivot axis defined by the pivot pins is positioned directly adjacent and opposite the elbow joint of the arm, so that the two shells may be relatively rotated about the pivot axis therefor when the arm is allowed to bend, in the manner to be described below. The shells 12 and 14 are biassed in mutually-opposite directions, in a first state thereof, by an elongated, elastic band or spring element 22, which spans the rear surfaces of the shells 12 and 14. The band 22 is formed into a closed loop, as shown in FIG. 1, and since, in the first state thereof, the closed loop is positioned in its entirety rearwardly of the pivot axis of rotation of the shells, the shells 12 and 14 are caused to assume a rectilinear, aligned state, as shown in FIG. 2, which constitutes the first, stable state thereof. A plurality of projecting pins 30, 32, and 34 on the rear surface of the upper shell 12, in combination with a plurality of projecting pins 36 and 38 projecting from the rear surface of the lower shell 14, define the closed loop of the band 22, such that the band is placed in tension to develop a biassing force thereby that causes the shells 12 and 14 to assume the first, rectilinear state shown in FIG. 2. Of course, the precise biassing force thus developed in the band may be changed by choosing a band 22 of different elastic properties, as well as by changing the length of the outer circumference formed by the boundary of the projecting pins. Toward this latter end, each projecting pin may have associated therewith at least two insertion-holes in which it may be inserted, so that the overall length of the closed loop may be altered to thus affect the tensioning thereof. In FIG. 1, each projecting pin is shown affixed to a respective rear surface of a respective shell, but, in a modification thereof as just described, there may be two holes associated with each pin, such that each pin is removably, but firmly held, in a chosen hole. Each pair of holes associated with each pin may be arranged perpendicularly, such that the holes of each pair extend along the same vertical plane. If desired, more than two holes for each pin may be used, such being formed in a triangular array.

Figure 10:
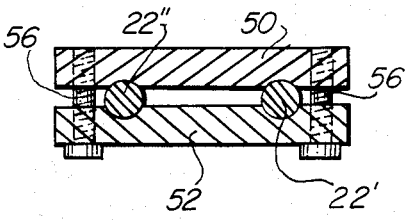
FIG. 10 is a cross-sectional view taken along line 10—10 of FIG. 9.

As described above, FIGS. 1, 2, and 6 show the first, stable state of the shells 12 and 14 and the band 22, when the arm of the person is kept straight and restrained from bending by the biassing force of the band 22. In this state, the band 22 tends to rotate the upper shell 12 in the counter-clockwise direction, when viewing FIG. 2, while tending to rotate the lower shell 14 in the clockwise direction. The limits of such rotation are effected by the overlapping end-portions 12' and 14', which abut one another in the first, stable state. This first state of the shells 12 and 14 and band 22 is used in order to lock or keep the arm straight, so that a bowler, or the like, is prevented from bending his arm during his approach to the alley, or the like. Clearly, this very same device may, therefore, be used as a simple orthopedic brace. The biassing force, and, thus, the torque imposed on the shells 12 and 14 by the band 22, are sufficient enough to resist any bending of the arm and, thus, relative rotation of the shells 12 and 14, for all normal bending moments of the lower arm with respect to the upper arm. Thus, during the delivery of the bowler, or the like, the rearward and forward movements of the arm occur with the arm completely straight, since the shells 12 and 14 are prevented from relatively rotating by the band 22. As explained above, the force necessary to prevent this relative rotation will vary upon the type, size, delivery, and speed of the bowler, or the like. The necessary biassing force may be achieved experimentally for each particular user of the device of the present invention, and the force may be finely adjusted by stretching the band 22 more or less about the pins 30–38. This fine adjustment is accomplished by an adjustable clamping member 48 shown in FIGS. 9 and 10. The clamping member 48 is made up of a pair of plates, upper plate 50 and lower plate 52. Each plate 50 and 52 has a pair of elongated depressions formed along the length thereof in which is positioned an end portion 22', 22'' of the band loop 22. The plates 50 and 52 are fastened together by screws 56, to thus clamp therebetween the ends of the band. Thus, when loosening the clamping plates 50 and 52, the ends 22' and 22'' of the band may be either extended to a greater extent through the clamping member to thus shorten the effective circumference of the loop, and thereby increase the tension thereof when wrapped about the pins 32–38, or may be shortened in extent therein to reduce the tensioning force thereof when wrapped about the pins 32–28. Thus, each individual user may adjust the device to his or her own particular needs by loosening the screws 56, and then re-adjusting the end-portions 22' and 22'' of the loop between the plates. This fine adjustment ensures that during forward and rearward movement of the arm for bowling, or the like, the arm will be forced to remain straight and unbent.

As noted above, it is advantageous to allow the arm, to which the shells 12 and 14 are secured, to bend at an opportune moment, whether it be for the end-point of delivery of a bowling ball, during the follow-through of a golf stroke, or the follow-through of a tennis racket. The band 22 also serves this function, in that upon the application of sufficient force and counter-torque by the lower arm, the biassing force of the band 22 is overcome to force the shells to rotate relative to each other about the pivot axis 18, and also cause the band 22 to take a second, stable state that tends to urge rotation of each of the shells 12 and 14 in a direction opposite to that occurring in the first, stable state. This is accomplished by a pair of additional, second-state stop-pins 60 and 62, located on opposite sides of the pins 30–38. Pin 60 projects from one side portion of the rear surface of the shell 14, while the other pin 62 projects from the other side thereof, as clearly shown in FIG. 1. Like the other pins 30–28, the pins 60 and 62 have enlarged head portions 60' and 62'', respectively, so that the band 22 may be held in place thereby. When the shells 12 and 14 are caused to rotate about pivot axis 18, the leg-portion of the band 22 between pins 34 and 36, and the leg-portion between the pins 30 and 38 are forced outwardly toward the pins 62 and 60, respectively, because of the movements of the pins 30–38 beyond the imaginary plane containing therein the pivot axis of the shells. The rear surface of the shells 12 and 14 also act as guiding surfaces for the leg-portions, as the shells are rotated initially against the biassing force of the band 22. Upon the continued rotation of the shells against the tension of the band 22, a certain point is reached at which the two leg-portions above-described jump over to their new, second stable state in abutting relation against the respective pins 60 and 62. Since each of the pins 60 and 62 lies in an imaginary plane on the opposite side of the pivot axis 18 as compared to the imaginary planes in which the pins 30–38 lie in the first state, the band 22 thus tends to bias the shells 12 and 14 in a direction opposite to which it tends to rotate them in the first, stable state. This second, stable state is shown in FIGS. 7 and 8, where it can be seen that the two shells 12 and 14 are urged toward each other to keep the arm in its newly-bent position. Upon sufficient force by the arm tending to straighten it again, the band 22 is forced to jump back to its first, stable state, where it is kept straight thereby. Thus, it can be seen that the arm-straightening device of the present invention allows for two stable states, each serving its own function, where either of which may be changed to the other state by the application of a predetermined and pre-set force, accomplished by the clamping member 48. The transition between states takes place instantly, such that the leg-portions jump between their relative positions in the two states thereof.

The shells 12 and 14 are preferably made of a hard plastic, with the inner layer of padding 19 being made of a soft felt, or the like. While the number of pins 32–38 have been arranged as shown, other patterns thereof are possible. Further, the emplacement of the stop pins 60 and 62 on the lower shell portion is not meant to be limiting, since they may be mounted to the rear surface of the shell 12. Further, the shape of the shells 12 and 14 may take other than a semicircular one. Further, just as in the case of the pins 30–38, the pins 60 and 62 may be made removably mountable to a number of holes in order to adjust the biassing force exerted by the band 22 when in the second, stable state thereof. Such may be accomplished by a plurality of holes for each pin 60 and 62, as above-described for the pins 30–38.

While a specific embodiment of the invention has been shown and described, it is to be understood that numerous changes and modifications may be made therein without departing from the scope, spirit, and intent of the invention as set out in the appended claims.

What is claimed is:

1. An arm-straightening and locking device with automatic releasing means for bowlers and golfers, comprising:

a first, upper shell-portion for placement about the upper, rear portion of an arm;

a second, lower shell-portion for placement about the lower, rear portion of an arm of a bowler or golfer;

means for pivotally connecting the lower end of said first shell-portion to the upper end of said second shell-portion to allow relative rotation therebetween, such that said shells may be in rectilinear alignment in a first relative orientation, and may be positioned at an angle relative to each other in a second relative orientation;

biassing means operatively connected with each of said first and second shell-portions for urging in a first state thereof said first and second shell-portions into said first relative orientation where they are in a substantial rectilinear alignment, and for urging in a second state thereof said first and second shell-portions away from said first relative rectilinear orientation toward said second relative orientation where said shell-portions are positioned at an angle with respect to each other, such that at the point of follow-through said shell-portions are allowed to have relative rotational movement upon the application of sufficient force to cause said biassing means to take said second state thereof; and means for mounting said biassing means in said first state and said second state, and for allowing movement of said biassing means between said first and second states.

2. The arm-straightening device according to claim 1, wherein said biassing means comprises an elongated spring-band member forming a substantially closed loop defining a first, upper leg-portion operatively associated with the rear of said first, upper shell-portion, a second, lower leg-portion operatively associated with the rear of said second, lower shell-portion, a third leg-portion spanning the rear portions of said first and second shell-portions between corresponding ends of said first and second leg-portions, and a fourth leg-portion spanning the rear of said first and second shell-portions between the other corresponding ends of said first and second leg-portions.

3. The arm-straightening device according to claim 2, wherein said means for mounting said biassing means comprises a plurality of pin-members projecting from the rear surface of each of said first and second shell-portions; said elongated spring-band member encircling said plurality of pin-member to thereby stretch and tension said spring-band member to provide the biassing force necessary for holding said shell-portions in said relative orientations.

4. The arm-straightening device according to claim 3, wherein said plurality of pin members comprise at least a first pair of spaced pin-members on the rear of said first, upper shell-portion, and at least a second pair of spaced pin-members on the rear of said second, lower shell-portion; the length of said spring-band member between said first pair constituting said first leg-portion, and the length of said spring-band member between said second pair constituting said second leg-portion.

5. The arm-straightening device device according to claim 4, wherein said means for mounting further comprises a third pair of pin-members projecting from the rear surface of at least one of said first and second shell-portions, each of said third pair of pin-members lying outside of a straight line connecting corresponding pin-members of each of said first and second pairs of pin-members such that each pin-member of each of said first and second pairs of pin-members is positioned closer to the central, bisecting longitudinal plane of each of said shell-portions than each of said pins of said third pair of pin-members, said plane being perpendicular to the axis of relative rotation of said first and second shell-portions.

6. The arm-straightening device according to claim 5, wherein said third pair of pin-members is mounted on said rear surface of said first, upper shell-portion, one of said third pair of pin-members lying adjacent one side edge surface of said first, upper shell-portion, and the other of said third pair of pin-members lying adjacent the other side edge surface of said first, upper shell-portion; said third pair of pin-members serving as abutment stops for said third and fourth leg-portions of said spring-band member when said first and second shell-portions are rotated relative to each other, whereby said spring-band member may take said second state thereof to urge said shell-portions toward each other about said means for pivotally connecting said shell-portions.

7. The arm-straightening device according to claim 5, wherein said third pair of pin-members is mounted directly adjacent to said means for pivotally connecting said shell-portions; one of said pin-members of said third pair of pin-members lying directly adjacent one side edge surface of one of said first and second shell-portions, and the other of said third pair of pin-members lying directly adjacent another side edge surface of one of said first and second shell-portions oppositely-disposed to said one side edge surface, whereby when said shell-portions are relatively rotated by overcoming the biassing force of said spring-band member, said spring-band member is forced toward said pin-members of said third pair and held thereat, to constitute said second state of said biassing means.

8. The arm-straightening device according to claim 2, further comprising means for adjusting the biassing force of said spring-band member, said means for adjusting comprising means for decreasing and increasing the length of said loop of said spring-band member.

9. The arm-straightening device according to claim 2, wherein said first shell-portion comprises a first means for releasably attaching said first shell-portion to the upper arm of a person; and said second shell-portion comprises a second means for releasably attaching said second shell-portion to the lower arm of a person.

10. The arm-straightening device according to claim 1, wherein said first, upper shell-portion is substantially semicircular in cross-section, and said second, lower shell-portion is also substantially semicircular in cross-section; the lower end of said first, upper shell-portion overlapping the upper end of said second, lower shell-portion; said means for pivotally connecting mounting said overlapping portions for relative rotational movement.

11. A method of locking an arm in a straight position and automatically allowing the bending of the arm upon the application of sufficient force, comprising:

manually mounting an upper-arm holding portion to the rear part of the upper arm of a person;

manually mounting a lower-arm holding portion to the rear part of the lower arm of a person;

biassing the upper-arm holding portion and the lower-arm holding portion to urge the upper-arm portion in one direction and to urge the lower-arm portion in the other direction, so that the arm portions are caused to extend in rectilinear fashion to prevent the bending of the arm to which the arm portions are secured;

said step of biassing comprising preventing the bending of the arm about the elbow-joint thereof absent a sufficient force provided by the lower-arm of the person about the elbow-joint thereof;

negating said step of biassing by manually rotating in the forward direction the lower arm with sufficient force to overcome the biassing force provided in said step of biassing;

applying a counter-biassing force to the arm-portions after said step of negating such that the upper-arm portion is urged to rotate in the other direction and the lower-arm portion is caused to rotate in the one direction when the lower arm of the person causes a force to be exerted about the elbow-joint at least equal to the sufficient force during said step of manually rotating;

said step of applying a counter-biassing force occurring automatically and immediately after the start of the forward bending of the lower arm of the person;

said step of applying a counter-biassing force causing said arm-portions to assume relative positions where they extend at an acute angle with respect to each other; said step of applying a counter-biassing force holding the arm-portions in said relative positions absent sufficient force from the lower arm of the person tending to straighten the arm and cause the arm-portions to assume their rectilinear, aligned position; and automatically reverting back to said step of biassing when sufficient force is supplied by the lower arm to cause the straightening of the arm thereby.

12. The method according to claim 11, wherein said step of automatically reverting back comprises the additional step of simultaneously and automatically negating said step of applying a counter-biassing force.

13. The method according to claim 11, wherein said step of automatically applying a counter-biassing force occurs immediately after said step of negating said biassing force.

14. The method according to claim 11, further comprising the step of adjusting the biassing force according to the needs of an individual.

* * * * *